US008081137B2

(12) United States Patent
Chang et al.

(10) Patent No.: US 8,081,137 B2
(45) Date of Patent: Dec. 20, 2011

(54) AIR-SUPPORTED SANDWICH RADOME

(75) Inventors: Kaichiang Chang, Northborough, MA (US); Richard Warnock, Mountain View, CA (US); Dean Pichon, Bolton, MA (US); Michael G. Sarcione, Millbury, MA (US); Sharon Ann Elsworth, Mason, NH (US); Marvin Fredberg, Stoughton, MA (US)

(73) Assignee: Raytheon Company, Waltham, MA (US)

( * ) Notice: Subject to any disclaimer, the term of this patent is extended or adjusted under 35 U.S.C. 154(b) by 1025 days.

(21) Appl. No.: 11/906,729

(22) Filed: Oct. 3, 2007

(65) Prior Publication Data

US 2009/0091509 A1 Apr. 9, 2009

(51) Int. Cl.
*H01Q 1/42* (2006.01)

(52) U.S. Cl. ..... 343/872; 343/873; 343/910; 343/911 R

(58) Field of Classification Search ..... 343/872, 343/873, 910, 911 R
See application file for complete search history.

(56) References Cited

U.S. PATENT DOCUMENTS

| | | | | |
|---|---|---|---|---|
| 2,959,785 | A * | 11/1960 | Leatherman et al. | 343/872 |
| 4,506,269 | A | 3/1985 | Greene | |
| 5,459,474 | A | 10/1995 | Mattioli et al. | |
| 5,662,293 | A * | 9/1997 | Hower et al. | 244/133 |
| 2004/0227682 | A1 | 11/2004 | Anderson | |
| 2005/0014430 | A1 | 1/2005 | Fredberg et al. | |
| 2005/0024289 | A1 * | 2/2005 | Fredberg et al. | 343/872 |
| 2007/0030205 | A1 | 2/2007 | Farrell et al. | |

* cited by examiner

*Primary Examiner* — Dieu H Duong
(74) *Attorney, Agent, or Firm* — Iandiorio Teska & Coleman

(57) ABSTRACT

An air-supported sandwich radome with a hemispherical top region and a prolate region has a high strength, RF transmissive, low dielectric flexible wall. There is a defined region where damaging RF radiation is reflected. At least in the defined region, a flexible high strength, RF transmissive low dielectric layer is added and there is a low dielectric gap between the wall and the layer providing a 180° phase delay between RF energy reflected off the wall and RF energy reflected off the layer to cancel the effect of said reflected RF energy on radar equipment housed by the radome.

23 Claims, 5 Drawing Sheets

AIR-SUPPORTED SANDWICH RADOME

FIELD OF THE INVENTION

This subject invention relates to radomes.

BACKGROUND OF THE INVENTION

Radar systems must be protected from the environment such as rain, snow, ice, etc., in some manner, usually by a structure called a radome. The design of a radome is not elementary. It must protect the transmit/receive (T/R) modules of the radar system for sensitivity compliance, it must allow transmission of RF energy through the radome, it must not reflect RF energy back at the radar system to prevent damaging its T/R modules, and the radome must be constructed at a suitable cost.

For inflated (air-supported) radomes made of a single-layer material such as Vectran, the optimum shape, from the perspective of reducing reflected energy back at the radar system, is a sphere. But, a sphere shaped radome must be extremely large and is thus costly. So, a prolate geometry is often used. But, the prolate geometry, especially when subject to wind loading and variations in air pressure, results in radar energy reflections which may damage the radar equipment housed within the radome.

In one example, an air-supported radome 103 feet tall had a base 103 feet in diameter, a top hemispherical region with a 60 foot radius, and a prolate region at the bottom. A radome reflected power of 8 dB above the transmit/receive module power was measured which damaged the transmit and receive modules of the radar system housed within the radome.

A rigid sandwich radome structure may not suffer from these reflections, but rigid sandwich radome structures are expensive, may have undesirable seams which can cause high scattering to degrade the radar performance, and are difficult to manufacture and erect when the size of the radome is, say, a hundred feet high with a radius of 60 feet.

BRIEF SUMMARY OF THE INVENTION

It is therefore an object of this invention to provide a new air-supported sandwich radome.

It is a further object of this invention to provide such a radome which better protects radar equipment housed therein.

It is a further object of this invention to provide such a radome in which any reflected RF energy is of lower power.

It is a further object of this invention to provide a method of reducing RF energy reflections in an existing radome.

It is a further object of this invention to provide such a method which can be implemented in the field.

The subject invention results from the realization that, in one embodiment, by adding a laminate including a flexible, high strength, RF transmissive, low dielectric Vectran layer and a low dielectric foam layer to at least a portion of the inside wall of an air-supported radome, transmission of the RF energy through the radome is not adversely affected but reflected RF energy power is lowered because the foam provides a 180° phase delay between the RF energy reflected of the outer radome wall and the RF energy reflected of the inner laminate layer.

The subject invention, however, in other embodiments, need not achieve all these objectives and the claims hereof should not be limited to structures or methods capable of achieving these objectives.

The subject invention features, in one example, an air-supported sandwich radome comprising a hemispherical top region and a prolate region with a high strength, RF transmissive, low dielectric flexible wall. There is a defined region where damaging RF radiation is reflected. At least in the defined region, a flexible high strength, RF transmissive low dielectric layer is added with a low dielectric gap between the outer wall and the inner layer. This laminate construction provides a 180° phase delay between RF energy reflected off the outer wall and RF energy reflected off the inner layer to cancel the effect of said reflected RF energy on radar equipment housed by the radome.

Preferably, the outer wall and the inner layer are made of the same material such as Vectran. The gap is preferably defined by a foam ply. The inner layer may be secured to the foam ply in the shape of geodesic tiles secured to the outer wall. Or, the inner layer may be secured to the foam ply in the shape of longitudinally extending strips secured to the outer wall.

In one example, the foam ply is ¼" thick and has a dielectric constant of less than 1.15. The foam ply may be a foam tape. To save material and to lower the cost, the geodesic tiles or strips may be secured to the outer wall only at the defined region.

The subject invention also features a method of reducing RF energy reflections in an air-supported sandwich radome. The preferred method comprises adding to the inside wall of the radome, at least at a defined region of the radome, a flexible, high strength, RF transmissive, low dielectric layer separated from the outer wall by low dielectric gap. This laminate structure provides a 180° phase delay between the RF energy reflected off the outer wall and RF energy reflected off the inner layer to cancel the effect of reflected RF energy on radar equipment housed by the radome.

One air-supported sandwich radome in accordance with this invention includes a high strength, RF transmissive, low dielectric, flexible wall, a flexible, high strength, RF transmissive, low dielectric layer, and a low dielectric gap between the outer wall and the inner layer providing a phase delay between RF energy reflected off the outer wall and RF energy reflected off the inner layer to reduce the effect of reflected RF energy on radar equipment housed by the radome. Typically, the low dielectric gap includes a foam ply between the wall and the layer.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
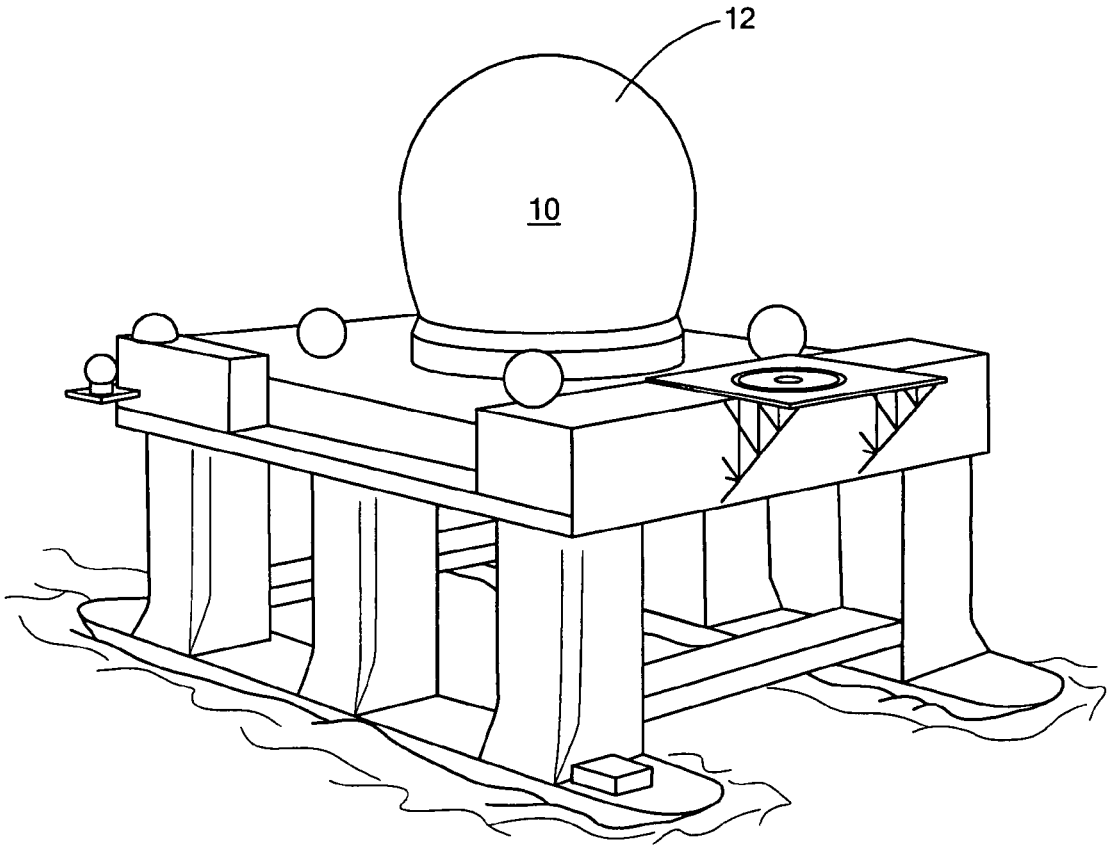
FIG. 1 is a schematic three-dimensional view of an air-supported radome in the field.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
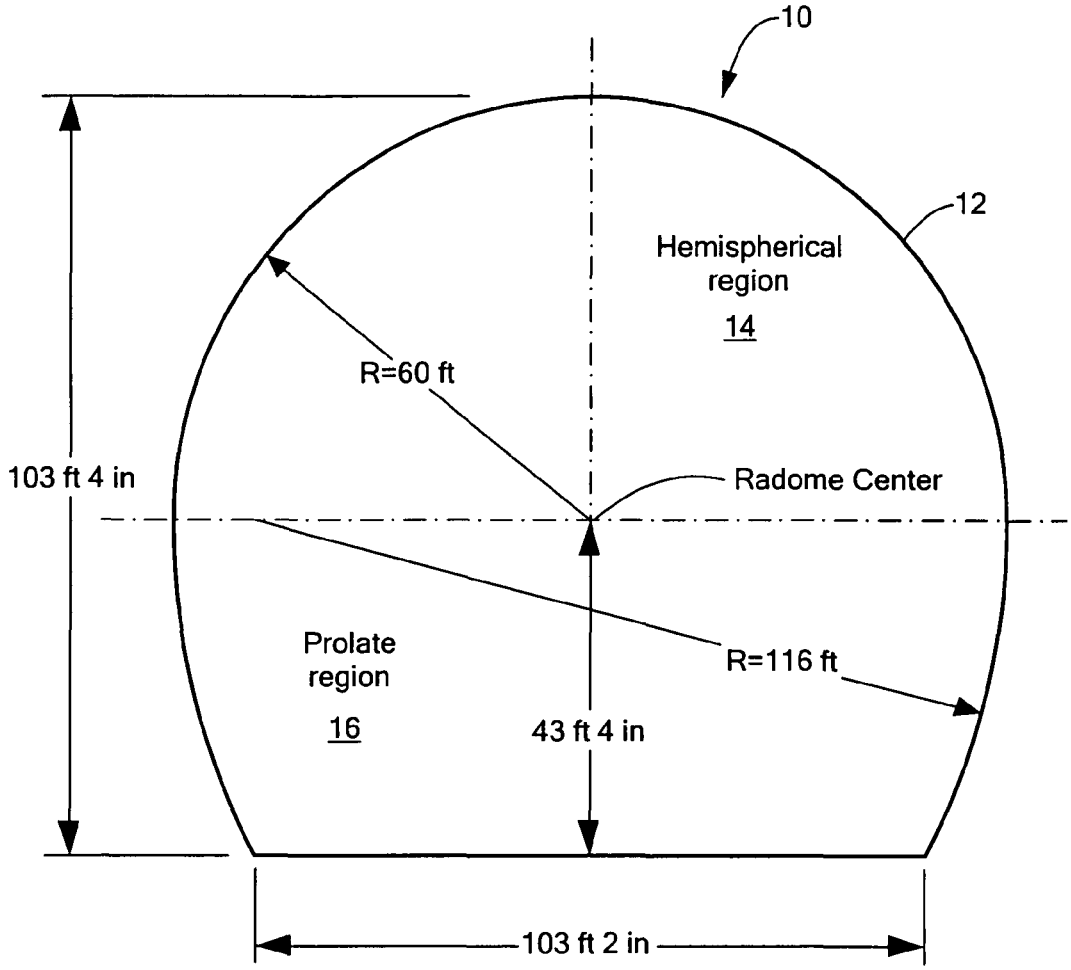
FIG. 2 is a schematic cross-sectional view depicting the typical geometry associated with a radome such as the radome shown in FIG. 1.

FIG. 1 shows air-supported radome 10 with a wall 12 made of quadraxial Vectran fabric. In one example, radome 10, FIG. 2 includes hemispherical region 14 with a radius of 60' and prolate region 16. The base of prolate region 16 is 103' 2" in diameter and prolate region 16 is 43' 4" high. Thus, the total height of the radome is 103' 4".

Figure 3:
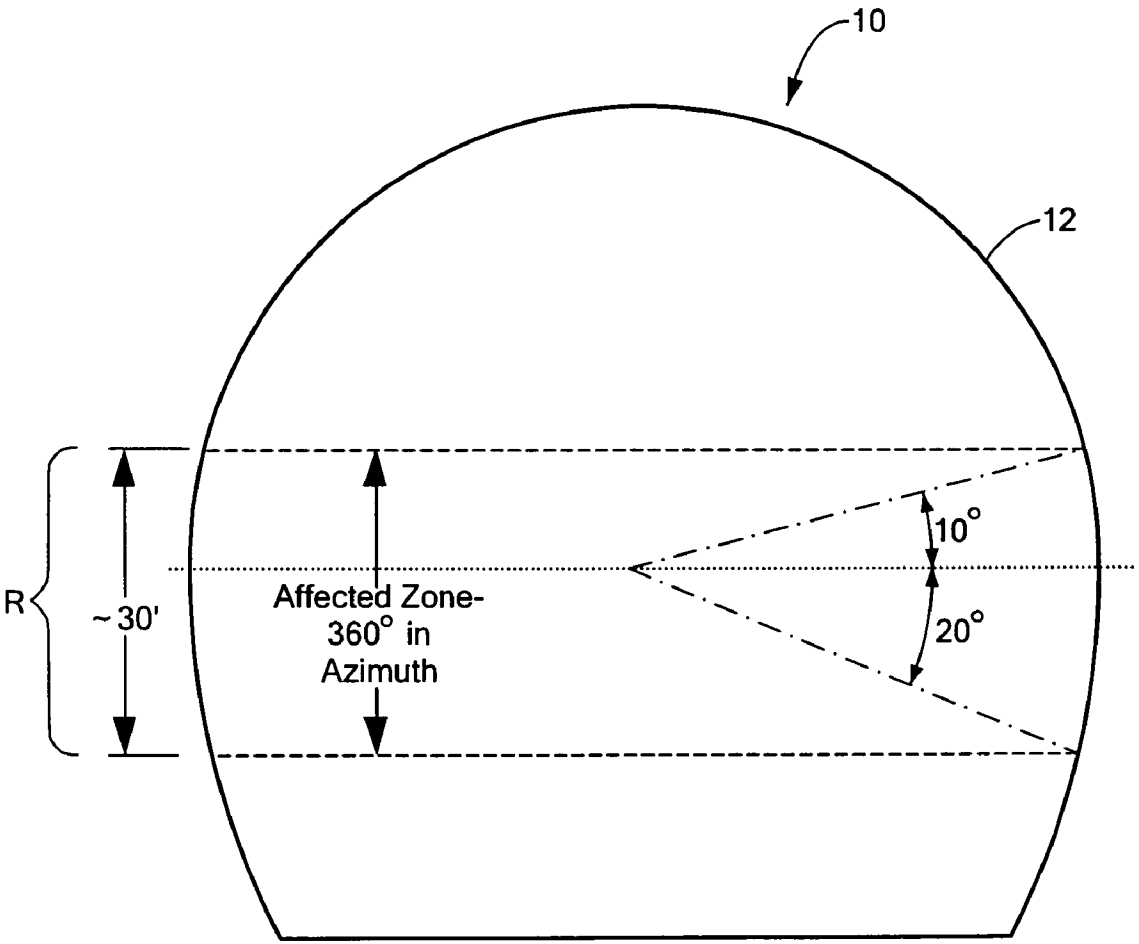
FIG. 3 is a schematic three-dimensional front view of a radome in accordance with the subject invention.

As discussed in the Background section above, a certain region of radome 10, FIG. 3, shown as region R, due to wind loading and variable air pressures, results in RF energy reflections off the inside of wall 12 at −12 dB. In this particular example, region R is 30' high and 377' in circumference. This reflected RF energy can damage the transmit and receive modules of the radar system housed within radome 10. Region R can be defined by taking measurements of reflected RF energy or by simulation using mathematical models.

Figure 4:
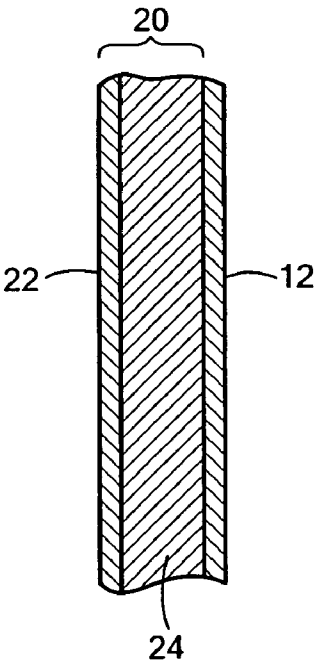
FIG. 4 is a schematic cross-sectional view showing a radome outer wall and added thereto an inner laminate layer in accordance with the subject invention.

In accordance with a preferred embodiment of the subject invention, laminate 20, FIG. 4 is secured to the interior of the outer wall 12 of the radome at least at region R in FIG. 3. One preferred laminate 20 includes a layer 22 of a flexible, high strength, RF transmissive, low dielectric material, typically Vectran or the same material of the same thickness as outer wall 12 of the radome. Layer 22 preferably has a dielectric constant of 2.8 or less. Foam ply 24 typically serves as a low dielectric gap between outer wall 12 and inner layer 22 and has a thickness sufficient to provide a 180° phase delay between RF energy reflected off outer wall 12 and RF energy reflected off inner layer 22 to cancel the effect of the reflected RF energy on radar equipment housed by the radome. Foam layer 24 may be PEI (e.g., Ultem foam, PVC-MMA (Airex R63), PET (Airex T90), urethane (Last-A-Foam 6703), PVC (Divinycell HT), MMA (Rohacell HF) or polyester (Aircell T-40). Foam layer 24 is typically ¼" thick and has a dielectric constant of less than 1.15. In another example, foam layer 24 is a foam tape (e.g., 3M 4004 foam tape).

Vectran layer 22 may be secured to foam layer 24 in a variety of ways including the use of low dielectric adhesives or tapes. Rigid stand offs may be added between Vectran inner layer 22 and outer wall 12 to maintain the required dielectric gap spacing.

Figure 5:
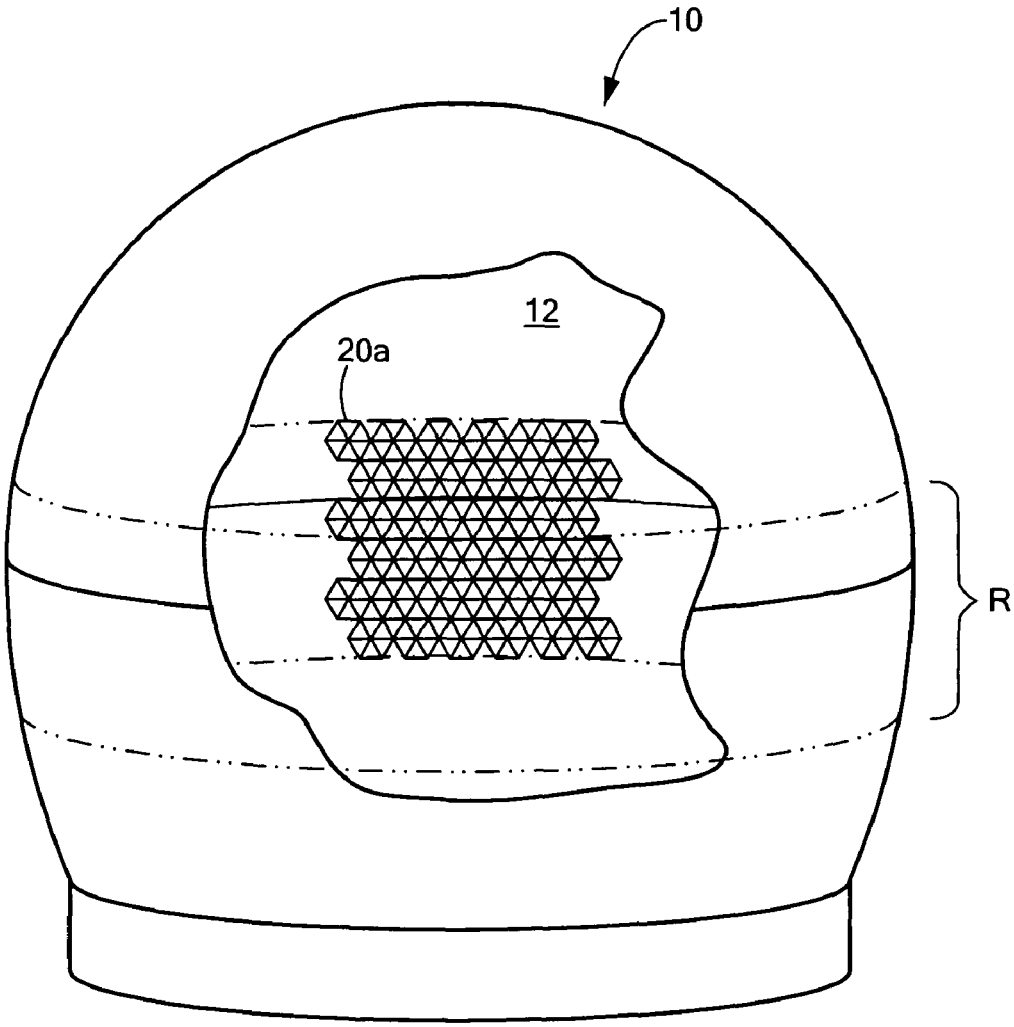
FIG. 5 is a schematic three-dimensional partially cut-away view of a radome showing how laminate tiles can be bonded to the interior of the radome wall in accordance with the subject invention.
Figure 6:
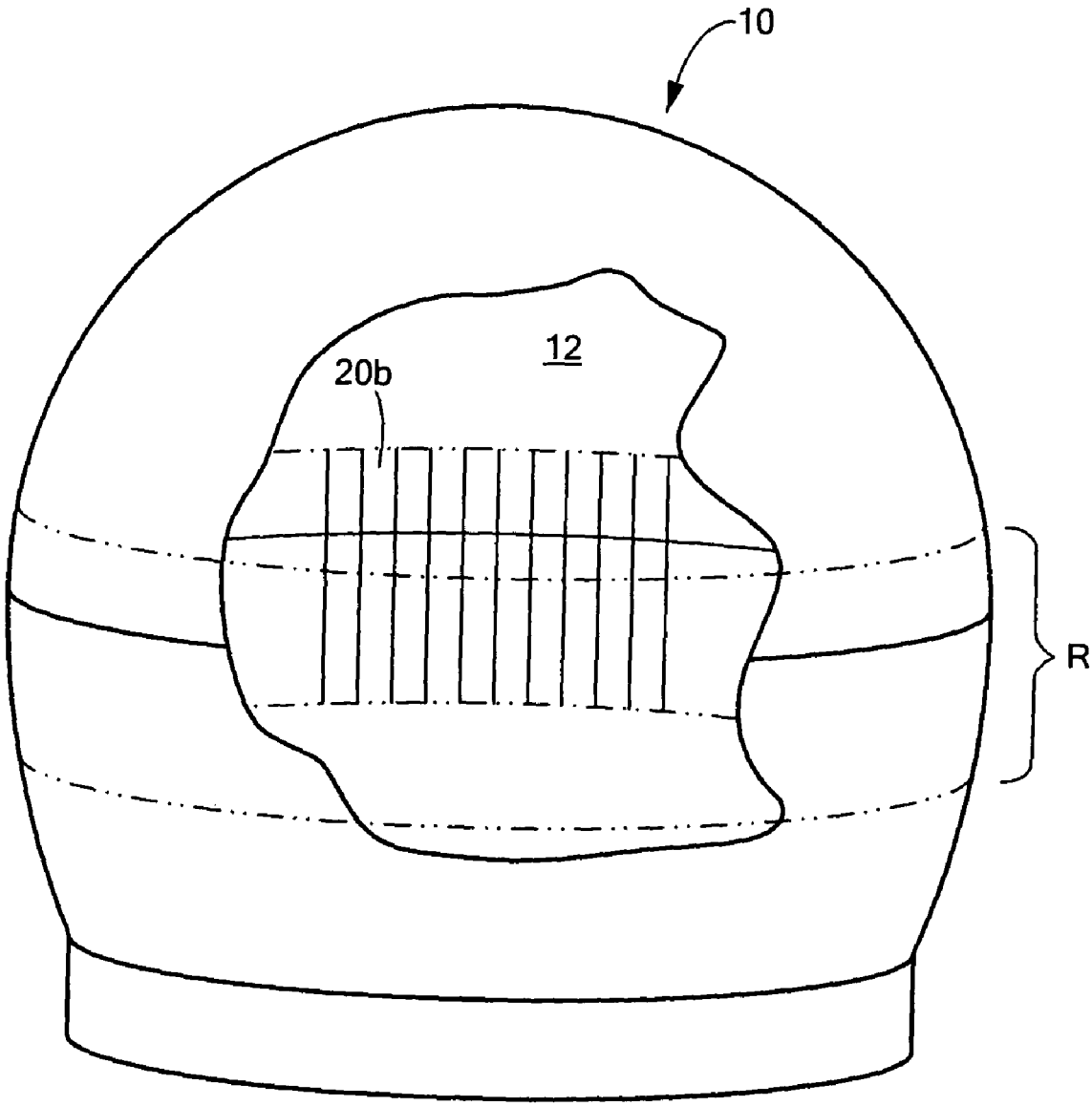
FIG. 6 is a schematic three-dimensional partially cut-away view showing how strips of a laminate in accordance with the subject invention can be bonded to the interior radome wall.

The shape of the laminate including Vectran inner layer 22 and foam layer 24 laminate may vary. As shown in FIG. 5, triangular tiles 20*a* (e.g., 36" on an edge) can be bonded (using adhesives or tapes) to the interior of the radome outer wall 12 in the shape of geodesic tiles. As shown in FIG. 6, long strips 20*b* (e.g., ~50" wide and 30' tall) can be bonded to the interior of radome wall 12. Tiles 20*a* and strips 20*b* can be constructed as discussed above with respect to FIG. 4. Other configurations are possible.

In this way, an existing air-supported radome can be modified in the field by adding, at least to a predefined region of the radome, usually on the inside wall thereof, a flexible, high strength RF transmissive, low dielectric layer separated from the outer wall by a low dielectric gap providing a 180° phase delay between the RF energy reflected of the outer wall and the RF energy reflected of the inner layer to cancel the effect of the reflected RF energy on radar equipment housed by the radome.

The result, in any embodiment, is a radome which better protects the radar equipment housed therein and wherein any reflected RF energy is of a lower power. In one simulation, focused radome reflected power was reduced to −3 dB level relative to the T/R module power which provides a good margin for transmit and receive module protection from radome reflection.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. An air-supported sandwich radome comprising:

a hemispherical top region and a prolate region with an RF transmissive, dielectric flexible wall;

a portion of the wall including a defined region where damaging RF radiation is reflected;

in the defined region, a flexible RF transmissive dielectric layer; and a dielectric gap defined by a foam ply between the wall and the layer providing a 180° phase delay between RF energy reflected off the wall and RF energy reflected off the layer to cancel the effect of said reflected RF energy on radar equipment housed by the radome.

2. The radome of claim 1 in which the wall and the layer are made of the same material.

3. The radome of claim 2 in which the material includes a quadraxial fabric.

4. The radome of claim 1 in which the layer is secured to the foam ply in the shape of geodesic tiles secured to the wall.

5. The radome of claim 4 in which the geodesic tiles are secured to the wall only at the defined region.

6. The radome of claim 1 in which the layer is secured to the foam ply in the shape of longitudinally extending strips secured to the wall.

7. The radome of claim 6 in which the strips are secured to the wall only at the defined region.

8. The radome of claim 1 in which the foam ply is ¼" thick and has a dielectric constant of less than 1.15.

9. The radome of claim 1 in which the foam ply is a foam tape.

10. A method of reducing RF energy reflections in an air-supported sandwich radome having a hemispherical top region and a prolate region with an RF transmissive, dielectric flexible wall, the method comprising:

adding to a portion of the inside wall of the radome, at a defined region of the radome where damaging RF radiation is reflected, a flexible, RF transmissive, dielectric layer separated from the wall by a dielectric gap defined by a foam ply providing a 180° phase delay between the RF energy reflected off the wall and RF energy reflected off the layer to cancel the effect of reflected RF energy on radar equipment housed by the radome.

11. The method of claim 10 in which the wall and the layer are made of the same material.

12. The method of claim 11 in which the material includes a quadraxial fabric.

13. The method of claim 10 in which the layer is secured to the foam ply in the shape of geodesic tiles secured to the wall.

14. The method of claim 13 in which the geodesic tiles are secured to the wall only at the defined region.

15. The method of claim 10 in which the layer is secured to the foam in the shape of longitudinally extending strips secured to the wall.

16. The method of claim 15 in which the strips are secured to the wall only at the defined region.

17. The method of claim 10 in which the foam ply is ¼" thick and has a dielectric constant of less than 1.15.

18. The method of claim 10 in which the foam ply is a foam tape.

19. An air-supported radome including a hemispherical top region and a prolate region, the radome comprising:

an RF transmissive, dielectric, flexible wall;

a portion of the wall including a defined region where damaging RF radiation is reflected, the defined region including a flexible, RF transmissive, dielectric layer; and a dielectric gap including a foam ply between the wall and the layer providing a phase delay between RF energy reflected off the wall and RF energy reflected off the layer to reduce the effect of reflected RF energy on radar equipment housed by the radome.

20. An air-supported sandwich radome comprising:

a hemispherical top region and a prolate region with a high strength, RF transmissive, low dielectric flexible wall;

a defined region where damaging RF radiation is reflected;

at least in the defined region, a flexible, RF transmissive dielectric layer; and a low dielectric gap defined by a foam ply between the wall and the layer providing a 180° phase delay between RF energy reflected off the wall and RF energy reflected off the layer to cancel the effect of said reflected RF energy on radar equipment housed by the radome, in which the layer is secured to the foam ply in the shape of geodesic tiles secured to the wall.

21. The radome of claim 20 in which the geodesic tiles are secured to the wall only at the defined region.

22. An air-supported sandwich radome comprising:

a hemispherical top region and a prolate region with a high strength, RF transmissive, low dielectric flexible wall;

a defined region where damaging RF radiation is reflected;

at least in the defined region, a flexible, RF transmissive dielectric layer; and a low dielectric gap defined by a foam ply between the wall and the layer providing a 180° phase delay between RF energy reflected off the wall and RF energy reflected off the layer to cancel the effect of said reflected RF energy on radar equipment housed by the radome, in which the layer is secured to the foam ply in the shape of longitudinally extending strips secured to the wall.

23. The radome of claim 22 in which the strips are secured to the wall only at the defined region.

* * * * *